United States Patent [19]

Shumaker et al.

[11] Patent Number: 4,972,776

[45] Date of Patent: Nov. 27, 1990

[54] SUBMARINE MINESWEEPER

[75] Inventors: Richard K. Shumaker; Louis F. Jones, both of Panama City, Fla.

[73] Assignee: The United States of America as represented by the Secretary of the Navy, Washington, D.C.

[21] Appl. No.: 365,301

[22] Filed: May 18, 1973

[51] Int. Cl.[5] ..... F42B 22/42

[52] U.S. Cl. ..... 102/402; 89/1.13; 114/245; 114/331; 114/335

[58] Field of Search ..... 102/18, 11, 402, 403; 114/20, 235, 242–247, 330–335; 89/1.818, 1.13

[56] References Cited

U.S. PATENT DOCUMENTS

| | | | |
|---|---|---|---|
| 2,996,006 | 8/1961 | Muzzey, Jr. | 102/409 |
| 3,175,525 | 3/1965 | Dries | 114/20.1 |
| 3,416,403 | 12/1968 | Smith | 102/402 |
| 3,469,551 | 9/1969 | Lefebvre | 114/242 |
| 3,492,962 | 2/1970 | Brainard, II | 114/230 |
| 3,548,708 | 12/1970 | Hubigh | 89/1.818 |
| 3,565,028 | 2/1971 | Hancks | 114/20.1 |

*Primary Examiner*—David H. Brown

*Attorney, Agent, or Firm*—Harvey David; John Becker; Sol Sheinbein

[57] ABSTRACT

An unmanned, self-propelled minesweeping apparatus, capable of sweeping at substantial depths, is described, comprising a torpedo-like submarine vehicle that deploys and tows a string of explosive mooring cable cutters terminating in a sea anchor. The sea anchor serves as a carrier for the cutters and the towline and, after ejection as a package from the vehicle, is actuated to an expanded condition and displaces the cutters and coils of towline therefrom.

18 Claims, 2 Drawing Sheets

SUBMARINE MINESWEEPER

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

This invention relates to the art of marine minesweeping, and more particularly to the sweeping of moored mines by apparatus that severs the mooring cables.

In the past, moored marine mines have been swept by streaming, from a surface ship or helicopter, sweeping apparatus comprising a sweep cable having one or more mooring cable cutters spaced there along, and means such as paravanes or diverters to cause the sweep cable to assume a position somewhat transverse to its direction of movement. A mine mooring cable engaged by the sweep cable slides therealong to one of the cutters, usually having an explosive actuated shear, and is severed. The mines so released float to the surface for disposal, as by gunfire.

Antisubmarine mines may be moored at any depth within the operating depth ranges of modern submarines. Such depths may be much greater than the depths at which their mooring can be cut by conventional sweeping equipment, as operated by vehicles on or above the sea surface. Moreover, in situations such as under Arctic ice, or where it is desired or necessary to conduct sweeping operations clandestinely with respect to enemy observation, the use of surface or air vehicles in performing sweeping operations is ruled out. Additionally, particularly with regard to submarines or other vessels not normally equipped to sweep mines, and operating at substantial distances from vessels or aircraft that can provide minesweeping services, it would be desirable to provide some form of portable, readily usable, mine removal capability for self protection.

SUMMARY OF THE INVENTION

The invention aims to overcome most or all of the mentioned disadvantages or shortcomings of the prior art through the provision of a novel self-propelled, unmanned, minesweeping submarine apparatus that can be carried by and launched in the same manner as a torpedo from ships, submarines, or aircraft. The invention contemplates that such apparatus be inexpensive relative to the acquisition, operation, and maintenance of conventional minesweeping systems, and that it can be recoverable or expendable, wholly or in part.

With the foregoing in mind, it is a principal object of the invention to provide an improved minesweeping apparatus that is compact, lightweight, inexpensive, and operable in a programmed manner after launching to effectively sweep a predetermined area by cutting the mooring cables of any mines within that area.

Another object of the invention is the provision of minesweeping apparatus that is operable at any depths traversed by modern submarines.

Another object is the provision of such apparatus comprising an unmanned submarine vehicle, having size, configuration and programmable motive ability characteristic of modern torpedoes, and which deploys and tows a cable or towline having a plurality of mine cable cutters spaced therealong and terminating in a sea anchor or drogue device, so that running of the vehicle along a circular or nearly circular course will cause the tow to assume a rotating spiral configuration that will effectively sweep a predetermined area.

Yet another object of the invention is the provision of apparatus of the foregoing character wherein the sea anchor, cutters, and towline are ejected from the submarine vehicle as r a package that automatically opens into the desired tow configuration.

Still another object is the provision of a novel self erecting sea anchor which serves initially as a holder for a plurality of cable cutters and coils of towline, the sea anchor being actuable to dispense the cutters and coils in a serial fashion that minimizes likelihood of fouling.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
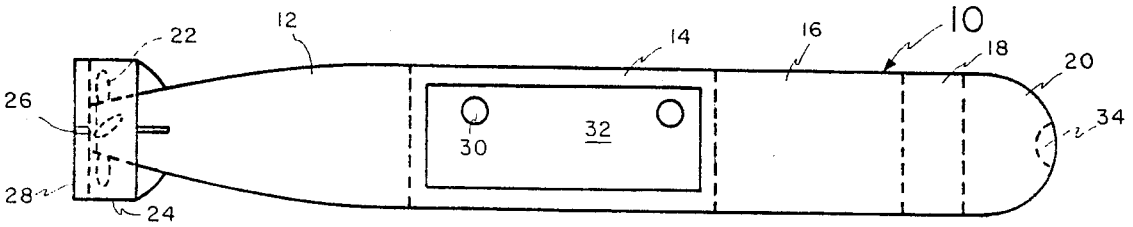
FIG. 1 is a side elevational view of a minesweeping submarine vehicle embodying the invention.

In the form of the invention illustrated in the drawings and described hereinafter, and with particular reference first to FIG. 1, there is provided an unmanned submarine vehicle generally indicated at 10, and characterized by the general shape and appearance of a conventional torpedo. The hull of the vehicle 10 is compartmented as shown in dotted lines to contain a propulsion motor section 12, a sweep gear stowage compartment 14, a fuel or battery compartment 16, a compartment housing attitude, depth, course, and speed controls, and a water ballast chamber 20. Vehicle 10 further comprises suitable propeller means 22 that is preferably surrounded by a shroud 24, and horizontal and vertical control surfaces 26 and 28. The sweep gear stowage compartment 14 is preferably free-flooding through suitable ports 30 in a closure member or door 32. A recessed lifting ring 34 is provided to aid in recovery.

Vehicle 10 is adapted to be launched by aircraft, surface ship, or submarine, in the manner of a conventional torpedo, and the control mechanisms in compartment 18 are capable of carrying out a predetermined course and depth program in maneuvering of the vehicle. Alternatively, the control mechanisms may be of the type that respond to acoustic command signals to initiate, modify, or terminate maneuvers of the vehicle.

Figure 2:
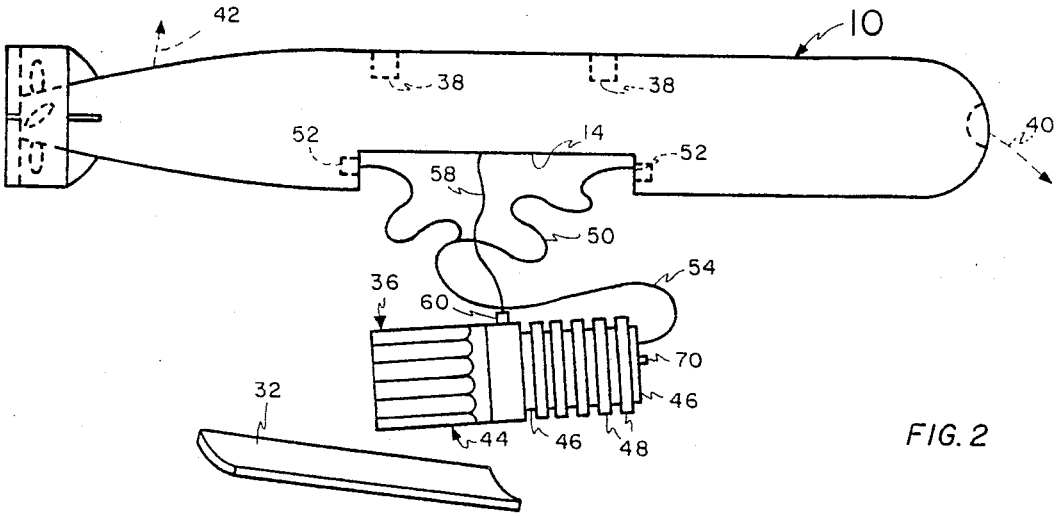
FIG. 2 is a plan view of the apparatus illustrating ejection of a sea anchor, towline, and cable cutter package from the vehicle of FIG. 1.

Referring now to FIG. 2, vehicle 10 is shown with door 32 falling away after being dislodged by ejection of a sweep gear package, generally indicated at 36, from the stowage compartment under the influence of thrusters 38 disposed within that compartment. During such ejection of package 36, vehicle 10 is following a more or less circular course in a horizontal plane, that course being indicated by the dotted line arrow 40.

The direction of turn is such that the rear section of the vehicle moves, as shown by arrow 42, outwardly or away from package 36 as it is ejected, thereby minimizing likelihood of fouling.

Figure 3:
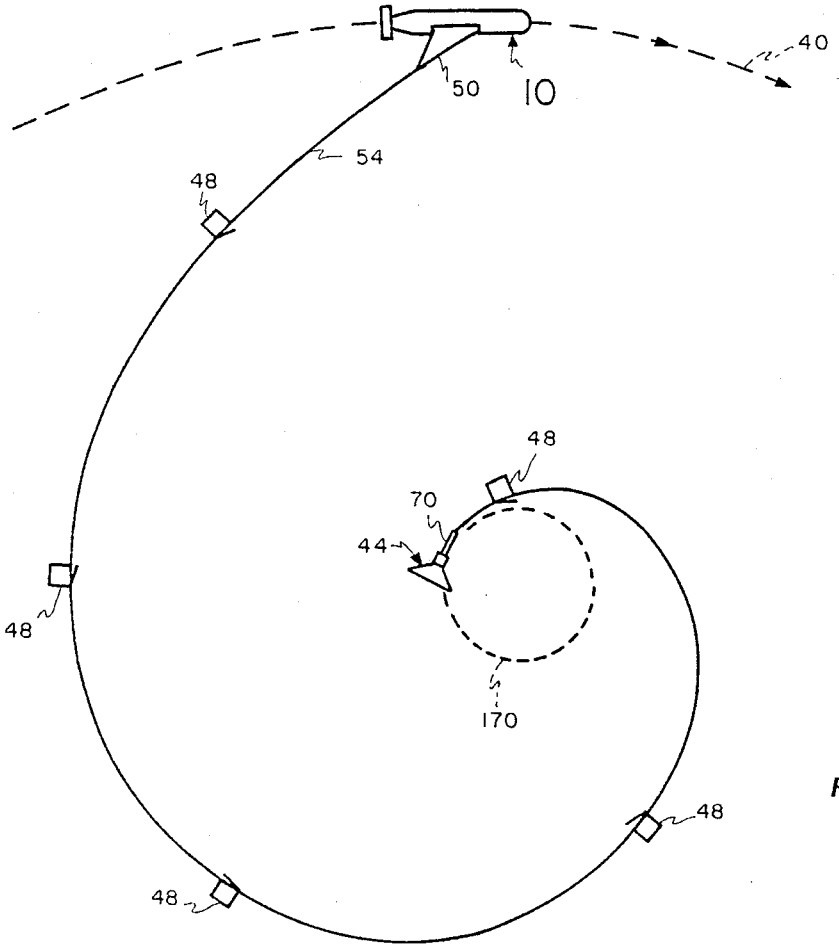
FIG. 3 is a plan diagrammatic view illustrating the circular vehicle path and spiral towline configuration of the sweeping apparatus in operation.

Package 36 comprises a sea anchor 44 in a folded condition, a plurality of coils or towline 46, and a plurality of cable cutting devices 48. A bridle of flexible line or cable 50 has its opposite ends connected to vehicle 10 by releasable connecting means 52, and serves to connect the vehicle to one end of a towline that is adapted to pay out from the coils 46 and has the cable cutters 48 spaced therealong. Package 36 is further connected to vehicle 10 by a static line 58 that is connected to the ring portion of an actuator sear pin 60 that is adapted to be pulled from package 36 as the package and the vehicle separate by more than the length of the static line. Removal of the pin 60 from package 36 initiates an action by which sea anchor 44 is unfolded in the nature of an umbrella and coils 46 and cutters 48 are forced from a central shaft 70 thereof. As a result, sea anchor 44 tends to remain stationary while vehicle 10 circles away therefrom causing towline 54 to uncoil and assume a spiral configuration as shown in FIG. 3. The cutter devices 48 are fixed at intervals along towline 54, and each comprises a vane or wing that reacts to movement of towline 54 horizontally through the water to maintain a mine cable snagging and cutting element directed toward the leading side of the towline. The cable cutting devices 48 may be any of several well known constructions, one of which is described in U.S. Pat. No. 3,020,871. In order to achieve the desired sweep pattern of towline 54, cutter devices 48, and sea anchor 44, it is preferable that these elements are characterized by substantially neutral buoyancy. Accordingly, line 54 may be made of a suitable material such as polypropylene, the wings of the cutter devices 48 may be made of a suitable plastic material, and sea anchor 44 may incorporate suitable buoyancy producing constructions.

Figure 4:
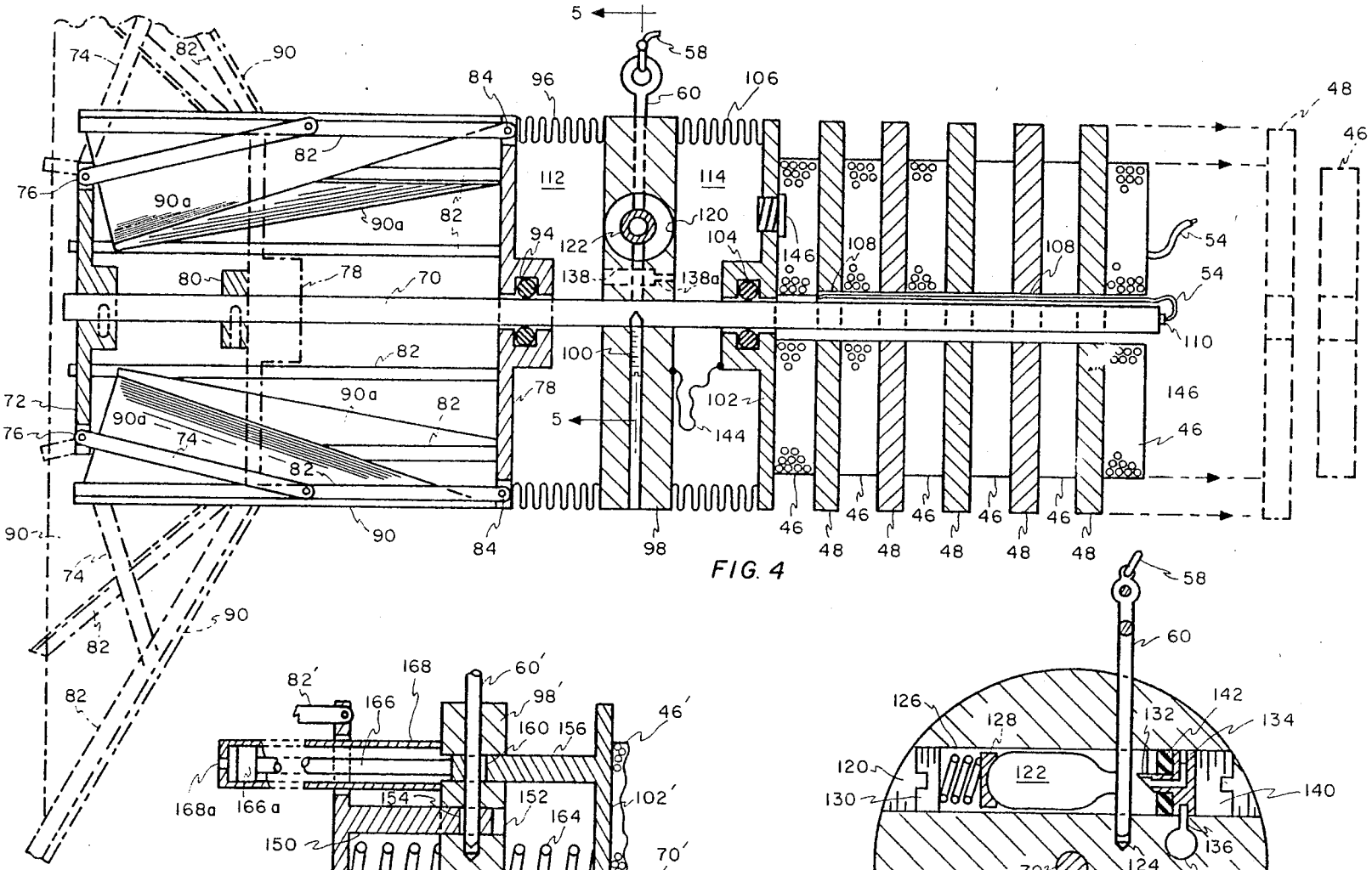
FIG. 4 is a longitudinal sectional view, on an enlarged scale, of the sea anchor, towline, and cable cutter package of the apparatus of FIG. 2.
Figure 5:
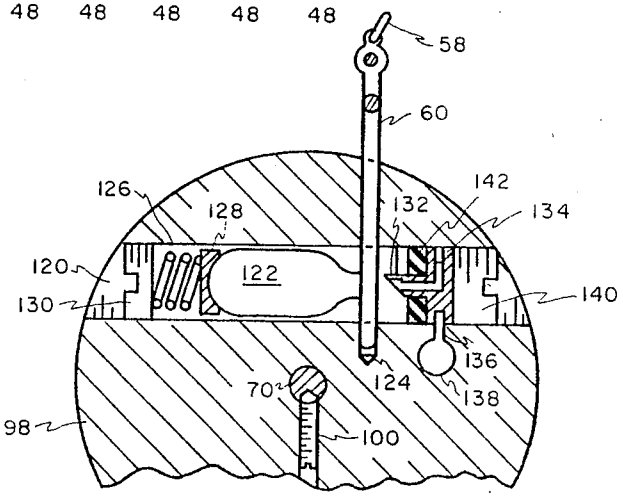
FIG. 5 is a fragmentary sectional view taken substantially along line 5—5 of FIG. 4.

Referring now to FIGS. 4 and 5, package 36, and especially sea anchor portion 44 thereof, will be described in more detail. Sea anchor 44 comprises a central shaft 70 which carries at one end a fixed hub 72. A plurality of links 74 are pivotally connected at 76 to the periphery of hub 72. A movable hub 78 is slidably mounted on shaft 70 for movement from its illustrated full line position to a dot and dash line position adjacent a fixed stop 80 on shaft 70. A plurality of spoke elements, equal in number to the number of links 74, each have one end pivoted !as at 84, to the periphery of movable hub 78. Each of links 74 has an end pivoted, as shown at 86, to the central portion of a corresponding one of the spokes 82.

A skirt 90 of flexible material is fixed to the outer edges of spokes 82 and, when in its full line position, is characterized by inwardly directed folds or convolutions of material 90*a* extending inwardly between the supporting spokes.

Hub 78 is sealed with respect to shaft 70 by means of an O-ring 94, and is connected by an expansible bellows 96 to a circular member 98 that is fixed to shaft 70, as by a set screw 100. Slidably mounted on shaft 70, on the opposite side of circular member 98 from hub 78, is a pusher member 102 that is sealed with respect to shaft 70 by an O-ring 104 and is connected to member 98 by an expansible bellows 106.

Disposed along shaft 70 are the previously mentioned coils 46 of towline 54 and the cutter devices 48 that are interconnected by the towline coils 46. The illustrated portions of cutter devices 48 are the wings or vanes thereof, each of which has been provided with an aperture 108 through which shaft 70 extends. The terminal end of line 54, leading from the innermost annular coil 46 of towline, extends along shaft 70 through the apertures of adjacent cutter devices and coils and is fixed to the distal end of shaft 70 as indicated at 110. Pusher member 102 is adapted to be driven along shaft 70 so as to displace or aid in displacing coils 46 and cutter devices 48 therefrom, as shown by the dot and dash line positions of a representative cutter 48 and coil 46.

Movements of hub 78 and pusher member 102 along shaft 70 away from member 98 are effected at a desired time after ejection of package 36 from vehicle 10 by release of compressed gas, such as carbon dioxide, into the spaces 112 and 114 defined respectively between hub 78 and member 98 by bellows 96, and between pusher member 102 and member 98 by bellows 106.

To this end, member 98 is provided with a through bore 120, best illustrated in FIG. 5, in which is disposed a pressurized $CO_2$ gas containing cartridge 122. Cartridge 122 is of a type well known for use in gas actuated devices wherein a pierceable seal is provided across the neck portion of the cartridge. Bore 120 intersects with a bore 124 in which is located the previously mentioned pin 60 that is connected to static line 58. Cartridge 122 is held with its neck portion against pin 60 by a compression spring 126. Spring 126 acts against a shoe 128 that bears against cartridge 122, and against a threaded plug 130 in the bore 120.

A hollow needle 132 extends from a spool member 134 in bore 120, the needle being axially aligned with the neck portion of cartridge 122. Spool member 134 is provided with an annular groove communicating with the interior of needle 132 and also communicating through passages 136 and 138 in member 98, with the space 112, and through a restrictive orifice 138*a* with space 114. Spool member 134 is held in position in bore 120 by a threaded plug 140 in the bore. A resiliently compressible gasket 142 is disposed in surrounding relation to needle 132.

When pin 60 is pulled out of member 98 by static line 58 after ejection of package 36 from vehicle 10, spring 126 drives cartridge 122 onto needle 132 which pierces the seal of the cartridge and permits pressurized gas therefrom to pass into spaces 112 and 114. The pressurized gas expands against hub member 78 and pusher member 102 causing them to move in opposite directions along shaft 70. Because of the restrictive action of orifice 138*a*, however, pusher member 102 moves much more slowly than hub member 78. The purpose of this slower movement will later be made apparent. Such movement of hub member 78 causes links 74 and spokes 82 to move to their dotted line positions, thereby opening skirt 90 to a frustro-conical position that serves effectively as a sea anchor. Pusher member 102 is moved slowly by gas pressure along shaft 70 and aids in displacing coils 46 of towline 54 and the cutter devices 48 connected thereto at a rate which will permit the line to be uncoiled by vehicle 10 with little likelihood of fouling. Movement of pusher member 102 along shaft 70 is conveniently limited by means of a flexible tether member 144 connected between pusher member 102 and member 98.

For purposes of positively scuttling the sea anchor after completion of its use, time responsive means may be provided for admitting water into one or both of spaces 112 and 114. Thus, a water soluble plug 146 may be provided in what would otherwise be an opening in pusher member 102, as shown, or in hub member 78 as an alternative.

Figure 6:
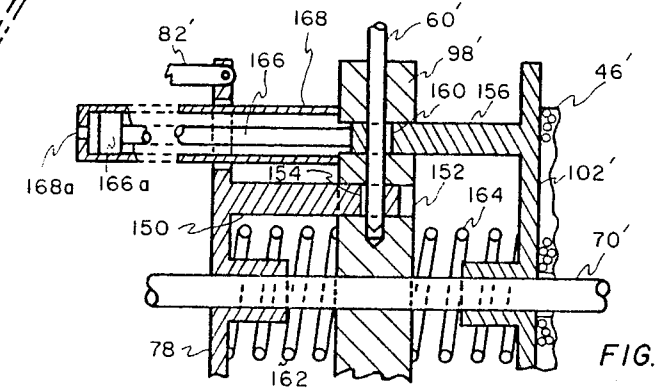
FIG. 6 is a fragmentary sectional view illustrating a modified embodiment of the invention.

A modified form of the invention is illustrated in FIG. 6, wherein elements corresponding to previously described elements are indicated by corresponding reference numerals with a prime marks added. In this embodiment, the sea anchor erecting movable hub element 78' comprises a rod 150 extending into an opening 152 in member 98'. Rod 150 is provided with an opening 154 therein through which extends pin 60'. Similarly, pusher member 102' is provided with a rod 156 extending into an opening 158 in member 98'. Rod 156 is provided with an opening 160 through which pin 60' extends.

A plurality of compression springs 162 are disposed between hub member 78' and member 98', while a plurality of compression springs 164 are disposed between pusher member 102' and member 98'. Removal of pin 60' from member 98', and from openings 154 and 160 in rods 150 and 156, respectively, releases hub member 78' and pusher member 102' for movement along shaft 70' under the influence of springs 162 and 164.

In order to slow the rate of movement of pusher member 102', rod 156 may be provided with dash-pot means including an extension in the form of a rod 166 having a piston **166*a* on the end thereof. Piston 166*a* is adapted to work in a cylinder 168 which is fixed to member 98', and is provided with a metering orifice 168*a* in the otherwise closed end thereof. It will be seen, therefore, that movement of pusher member 102' will be slowed with respect to movement of hub member 78' by metered induction of sea water through orifice 168*a*. Such movements serve to erect the sea anchor skirt and to displace the tow line coils and associated cutter devices in the same manner as described with reference to the embodiment of FIG. 4**.

In the embodiment of FIG. 4, the gas filled spaces serve to provide a degree of buoyancy whereby the sea anchor 44 may have substantially neutral buoyancy although the various parts skirt 90 which is preferably formed of a suitable flexible plastic material. It should be noted at this point that, although package 36 is desireably substantially neutral in buoyancy, it is advantageous for its trim or weight distribution to be such that it will assume a position in the water wherein shaft 70 is more or less vertical, with coils 46 at the upper end. As vehicle 10 pulls on towline 54, the package will tend then to tip only as necessary to release the coils and cutters one at a time from the shaft. Movement of pusher member 102 is calculated to bring the coils and cutters sequentially to positions adjacent the shaft end at the rate at which they are removed. Of course, should the coils and cutters not be pulled from shaft 70, pusher member 102 will, itself displace them from the shaft. The embodiment of FIG. 6, while it is lacking in inherently buoyancy producing, gas filled spaces, has the advantage for some circumstances of use of not requiring the use of pressurized gases.

From the foregoing detailed description, it will be appreciated that the invention has provided a novel sweeping apparatus for cutting the cables of antisubmarine moored mines at any desired depth and without the need for surface ships or aircraft. When it is desired, for example, to sweep a predetermined area, a vehicle 10 that has been suitably programmed may be released by a submarine while submerged. The vehicle 10 proceeds under its own power to the area to be swept and, at an assigned depth, then begins to follow a circular course. As the vehicle begins circling, thrusters 38 are actuated to eject package 36 as shown in FIG. 2. When separation of package 36 and vehicle 10 reaches the extent of static line 58, pin 60 pulls free of member 98, thereby initiating the erection of sea anchor 44 and displacement of towline coils 46 and associated cutters 48 from shaft 70.

As vehicle 10 circles, towline 54 uncoils and assumes the spiral configuration illustrated in FIG. 3. After towline 54, with its cutters, is fully deployed, one complete revolution of the vehicle, or slightly more, towline 54 will effectively sweep the entire annular area between circle 40 and a smaller circle 170 described by sea anchor 44. Any mine mooring cables extending through that area will be engaged by towline 54 and be lead thereby into the shearing portion of one of the cutter devices 48. Thereupon, the cutting device 48 in which the mooring cable becomes snagged, will explosively actuate a shear and cut the mooring cable in a manner well known to those skilled in the art to which the invention pertains.

The towline 54 can be caused to sweep within the smaller circle 170 by programming vehicle 10 to run a short tangential course after the above sweep is made, and then resuming a circular course.

When the fuel or battery charge of vehicle 10 is depleted, the towline, cutters, and sea anchors may be automatically jettisoned by programmed actuation of disconnect means 52. Additionally, ballast tank 20 may be blown to render vehicle 10 positively buoyant, whereupon it will rise to the water surface for recovery and subsequent reuse. In the case of clandestine sweeping operations, of course, vehicle 10 can be programmed to sink to the bottom, thereby avoiding any unnecessary revelation to the enemy of sweeping operations or the means by which cables to moored buoys have been cut.

Obviously, other embodiments and modifications of the subject invention will readily come to the mind of one skilled in the art having the benefit of the teachings presented in the foregoing description and the drawings. For example, other condition responsive means such as a water activated time delay and gas generating means could be used instead of the static line, sear pin, and cartridge to effect deployment of the sea anchor and towline at the appropriate time after ejection of package 36. It is, therefore, to be understood that this invention is not to be limited thereto and that said modifications and embodiments are intended to be included within the scope of the appended claims.

What is claimed is:

1. Minesweeping apparatus comprising in combination:

an unmanned submarine vehicle including propulsion means for moving said vehicle through the water, and programmable control means for causing said vehicle to effect predetermined maneuvers; and minesweeping gear carried by said vehicle for ejection therefrom in accordance with a predetermined condition in said maneuvers;

said minesweeping gear comprising a towline having one end connected to said vehicle, sea anchor means connected to the other end of said towline, and cable cutter means, carried by said towline, for shearing mine mooring cables engaged thereby.

2. Minesweeping apparatus as defined in claim 1, and wherein:

said sea anchor comprises a shaft portion, a foldable skirt portion, and means for expanding said skirt portion to an open condition.

3. Minesweeping apparatus as defined in claim 2, and wherein:

said towline is formed in coils disposed on said shaft portion of said sea anchor; and said sea anchor comprises means for displacing said coils of towline from said shaft portion.

4. Minesweeping apparatus as defined in claim 3, and wherein:

said cable cutter means comprises a plurality of cable cutter devices spaced along said towline, said cable cutter devices each being characterized by a wing portion having an opening through which said sea anchor shaft portion is received when said gear is carried by said vehicle.

5. Minesweeping apparatus as defined in claim 4, and wherein said means for expanding said skirt portion comprises:

a first hub member fixed to said shaft portion;

a second hub member slideable along said shaft portion toward said first hub member;

a plurality of spokes, each having one end pivotally connected to one of said hub members;

a plurality of links each having one end pivoted to the other of said hub members and another end pivoted to the mid portion of one of said spokes; and said skirt portion being formed of flexible material fixed to said spokes, whereby movement of said one hub member toward said other hub member causes said spokes to move, from positions substantially parallel to said shaft portion, to positions diverging from said shaft portion, so as to spread said skirt portion to a frusto-conical configuration.

6. Minesweeping apparatus as defined in claim 5, and wherein said means for expanding said skirt portion further comprises:

actuator means, mounted on said shaft portion, for effecting said movement of said one hub member.

7. Minesweeping apparatus as defined in claim 6, and further comprising:

pusher means, associated with said actuator means, for movement along said shaft portion to effect displacement of said coils and said cutter devices therefrom.

8. Minesweeping apparatus as defined in claim 7, and wherein said actuator means further comprises:

force producing means, disposed between said shaft portion and said hub and pusher means, for effecting said movements of said one hub member and of said pusher means;

restraining means, carried by said shaft portion, for releasably holding said force producing means in a static condition; and means coupled to restraining means, for releasing said force producing means in response to a predetermined condition after ejection of said minesweeping gear from said vehicle.

9. Minesweeping apparatus as defined in claim 8, and wherein said force producing means comprises:

means, connected between said shaft portion and said one hub member and between said shaft portion and said pusher means, for defining expansible chambers; and means, carried by said sea anchor means, for introducing a gas into said chambers at a pressure greater than ambient pressures.

10. Minesweeping apparatus as defined in claim 9, and wherein said force producing means comprises:

a body fixed to said shaft portion between said one hub member and said pusher means; and compression springs, confined between said body and said one hub member and between said body and said pusher means.

11. Minesweeping apparatus as defined in claim 9, and further characterized by:

a cartridge containing said gas under pressure, means for piercing said cartridge to release said gas into said chambers, and a sear pin movable from a holding position to permit said cartridge to be pierced; and said means for releasing said force producing means comprising a static line connected between said vehicle and said sear pin.

12. A self-propelled, unmanned, apparatus for sweeping moored mines, said apparatus comprising:

a submarine vehicle including propulsion means for moving said vehicle through the water, and programmable control means for causing said vehicle to perform predetermined maneuvers including circling in a substantially horizontal plane at a predetermined depth;

a package including a sea anchor having a shaft, a plurality of coils of towline disposed on said shaft, and a plurality of mine cable cutters disposed on said shaft and interconnected by towline in said coils, said towline further having one end connected to said vehicle and its other end connected to said sea anchor;

said package being carried within said vehicle and ejectable therefrom in response to a predetermined condition;

said sea anchor comprising a skirt portion that is carried in a folded condition when in said vehicle and is unfolded to an expanded shape after said package is ejected from said vehicle;

said sea anchor further comprising means for displacing said coils and cutters from said shaft and for opening said skirt portion from said folded condition to said expanded shape when said package is ejected and clear of said vehicle, whereby said circling of said vehicle and resistance offered by said sea anchor cause said towline to assume a revolving spiral configuration.

13. Apparatus as defined in claim 12, and wherein:

said means for displacing said coils and cutters and for opening said skirt portion comprises articulated elements and gas pressure powered actuator means therefor.

14. Apparatus as defined in claim 13 and wherein said sea anchor is further characterized by means for controlling the rate at which said coils and cutters are displaced.

15. Apparatus as defined in claim 14, and wherein said means for controlling the rate at which said coils and cutters are displaced comprises a gas flow regulating orifice.

16. Apparatus as defined in claim 12 and wherein:

said means for displacing said coils and cutters and for opening said skirt portion comprises articulated elements, and spring powered actuator means therefor.

17. Apparatus as defined in claim 16, and wherein said sea anchor is further characterized by means for controlling the rate at which said coils and cutters are displaced.

18. Apparatus as defined in claim 17, and wherein said means for controlling the rate at which said coils and cutters are displaced comprises a dash-pot.

* * * * *